US006907668B2

(12) United States Patent
Polei

(10) Patent No.: US 6,907,668 B2
(45) Date of Patent: Jun. 21, 2005

(54) UTILITY KNIFE

(75) Inventor: Gudula Polei, Solingen (DE)

(73) Assignee: Martor KG, Solingen (DE)

( * ) Notice: Subject to any disclaimer, the term of this patent is extended or adjusted under 35 U.S.C. 154(b) by 0 days.

(21) Appl. No.: 10/852,001

(22) Filed: May 21, 2004

(65) Prior Publication Data

US 2004/0250426 A1 Dec. 16, 2004

(30) Foreign Application Priority Data

May 22, 2003 (DE) ..... 103 23 760

(51) Int. Cl.[7] ..... B26B 1/08
(52) U.S. Cl. ..... 30/162; 30/335
(58) Field of Search ..... 30/151, 162, 164, 30/329, 335, 332, 336, 337, 338, 339, 2, 330, 331

(56) References Cited

U.S. PATENT DOCUMENTS

| | | | | | |
|---|---|---|---|---|---|
| 2,679,100 | A | | 5/1954 | Ehler | |
| 3,316,635 | A | | 5/1967 | Merrow | |
| 4,139,939 | A | | 2/1979 | Crooks | 30/2 |
| 4,835,865 | A | * | 6/1989 | Knoop | 30/162 |
| 5,283,954 | A | | 2/1994 | Szabo | 30/125 |
| 5,813,121 | A | * | 9/1998 | Gringer | 30/162 |
| 6,161,290 | A | * | 12/2000 | Takamasa | 30/162 |
| 6,163,963 | A | | 12/2000 | Huang | 30/162 |
| 6,263,577 | B1 | * | 7/2001 | Wonderley | 30/152 |
| 6,317,986 | B1 | * | 11/2001 | Huang | 30/162 |
| 6,418,624 | B1 | * | 7/2002 | Huang | 30/162 |
| 6,449,850 | B1 | | 9/2002 | Gilbert | 30/162 |
| 6,546,632 | B2 | | 4/2003 | Gilbert | 30/162 |
| 6,775,911 | B2 | * | 8/2004 | Tremblay | 30/162 |

FOREIGN PATENT DOCUMENTS

| | | |
|---|---|---|
| DE | 1 711 881 | 11/1955 |
| DE | 7 207 013 | 2/1972 |
| DE | 94 17 085 | 2/1995 |
| EP | 0 543 781 | 5/1993 |
| EP | 1 075 908 | 2/2001 |

* cited by examiner

*Primary Examiner*—Hwei-Siu C. Payer
(74) *Attorney, Agent, or Firm*—Herbert Dubno

(57) ABSTRACT

A utility knife has a main housing half formed with a throughgoing aperture, having a face, and formed on the face with a peripheral annular array of transversely projecting hooks each having an outer end and a secondary elongated housing half having a face and formed with a peripheral annular array like the array of the main half of transversely throughgoing undercut holes opening at the respective face. The halves are engageable together at their faces with the hooks projecting into the holes and are relatively shiftable when thus engaged to lock the hooks in the respective holes. The secondary half is formed with an aperture like the aperture of the first half and directly aligned therewith in the assembled position. A retaining member snugly engaged in and through the aligned apertures holds the halves in the assembled position. A blade between the halves projects longitudinally from the housing halves.

10 Claims, 4 Drawing Sheets

Fig.5
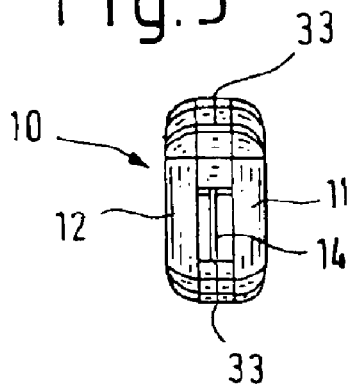
Fig.6
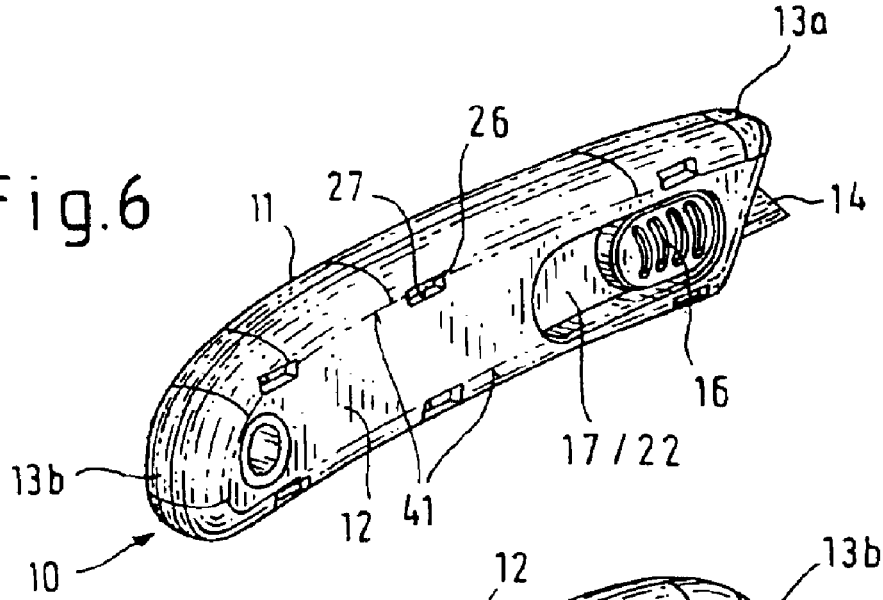
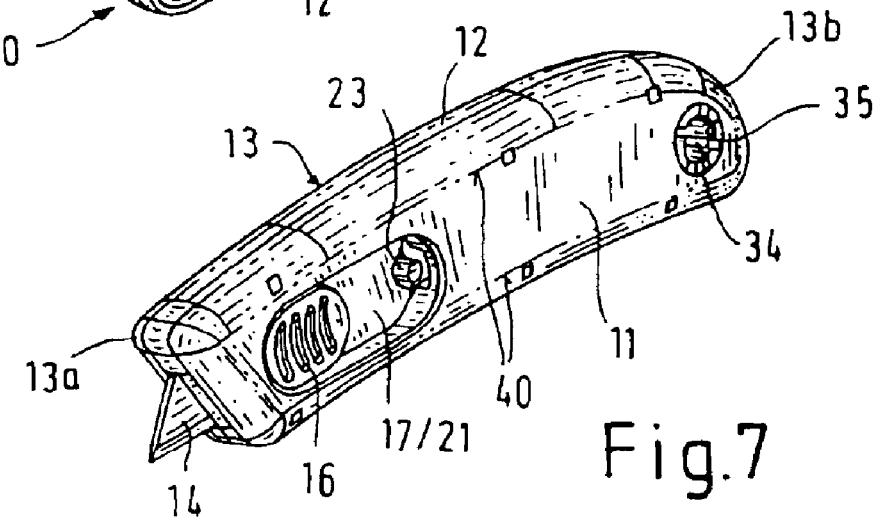
Fig.7

UTILITY KNIFE

FIELD OF THE INVENTION

The present invention relates to a utility knife. More particularly this invention concerns a utility knife that holds a normally trapezoidal flat blade.

BACKGROUND OF THE INVENTION

Utility knives are known from EP 0,543,781 (U.S. Pat. No. 5,283,954), German Utility Model 1,711,881, German Utility Model 7,207,013, German Utility Model 94 17 085, and U.S. Pat. Nos. 2,679,100, 3,316,635, 4,139,939, 6,163,963, 6,449,850, and 6,546,632 that have an elongated body formed as a grip or handle and from which can project a replaceable steel blade, typically of right-trapezoidal shape. Such a knife is used for opening packages, numerous construction applications, and in the food industry.

In most such utility knives the blade is mounted on a slide that can shift it between a retracted position with the blade wholly contained in the housing or handle, so that the knife can be pocketed safely, and an extended position with the blade projecting from a front end of the handle, so that the knife can be used. As a rule a button that actuates the slide and that normally is formed as part of the slide is exposed on the back edge or one side of the housing. The provision on the back edge has the advantage that it allows the knife to be used with equal facility by right- and left-handers, but this construction has the disadvantage that the resultant grip, with the thumb on the back of the knife, is frequently not strong enough. Provision of the button on the left side makes the knife difficult to use for left-handers.

The housing is often formed of two separate parts that can be separated to replace the blades, and often also to expose a compartment holding a supply of spare blades. In a standard model, a screw that can be operated by a coin is provided at one end of the housing extending between the housing halves. Thus the screw can be pulled to separate the two housing halves, making blade replacement possible. Such an arrangement has the disadvantage that the screw can easily get lost, making the knife unusable.

When used in the food-services industry, it is essential that the knife by constructed such that it does not have crannies that can hold food particles, leading to cross-contamination of product. In such an application it is desirable to make the knife disposable so that it can be replaced frequently, making the transmission of bacteria impossible.

OBJECTS OF THE INVENTION

It is therefore an object of the present invention to provide an improved utility knife.

Another object is the provision of such an improved utility knife which overcomes the above-given disadvantages, that is which is easy to operate, whose blade is easy to change, and which is of simple and inexpensive construction.

SUMMARY OF THE INVENTION

A utility knife according to the invention has a main elongated housing half formed with a transversely throughgoing aperture, having a flat face, and formed on the flat face with a peripheral annular array of transversely projecting hooks each having an outer end with a face directed back toward the flat face and a secondary elongated housing half geometrically similar to the main housing half, having a flat face, and formed with a peripheral annular array like the array of the main half of transversely throughgoing holes opening at the respective face and each having a ledge directed transversely away from the respective face. The halves are engageable together at their faces with the hooks projecting into the holes and are relatively shiftable parallel to the faces when thus engaged to hook the hook edges in an assembled position over the respective ledges. The secondary half is formed with an aperture like the aperture of the first half and directly transversely aligned therewith in the assembled position. A retaining member snugly engaged in and through the aligned apertures holds the halves in the assembled position. A blade between the halves projects longitudinally from the housing halves.

Such a construction is extremely simple. The knife is easily assembled by pressing the two halves together to opposite sides of the blade, shifting them so the hooks lock in the holes, and then installing the retaining member. The provision of an annular array of hooks around the periphery of the two parts ensures that they will be pressed against each other all around their edges, so that foreign matter cannot readily get caught between the two housing halves.

In accordance with the invention the two halves are made of plastic. Thus the main half is unitarily formed with the hooks so that at a minimum the knife comprises four simple parts.

The hook edges and ledges according to the invention are flat and complementarily angled to the respective flat faces. Thus on shifting into the assembled positions the edges and ledges press the flat faces together. When assembled the two halves are thus very solidly locked together and in fact prestressed together by elastic deformations of the hooks and hole ledges.

The blade in accordance with the invention projects longitudinally from a front end of the housing halves and the apertures are provided at an opposite rear end. In addition the retaining member is a sleeve and forms a transversely throughgoing hole at the rear housing end. This makes it possible to hang the knife by the retaining element which is solidly connected to both housing halves. The retaining sleeve has one end formed with radially outwardly projecting lips bearing transversely on one of the halves. It is permanently mounted in the apertures in a disposable knife. The outer ends of the apertures are formed as counterbores so that the entire sleeve can be recessed below the outer surface of the knife.

According to another feature of this invention the housing halves together form an internal longitudinally extending guide and at least one of the halves is formed with a longitudinally elongated and transversely throughgoing slot at the guide. A slide holding the blade is longitudinally displaceable in the guide between a retracted position with the blade wholly contained in the housing halves and an extended position with the blade projecting longitudinally from the housing halves. This slide has an actuation button exposed at the slot. More particularly the slide has a pair of similar halves sandwiching the blade, and both of the housing halves are formed with one such longitudinally elongated slide. Each slide half is formed with one such button exposed at the respective slot. Thus the knife is usable as easily in the right hand as in the left hand, but costs no more to manufacture than a standard utility knife.

For safety's sake, a tension spring is provided having a front end connected to the slide and a rear end connected to the housing. This spring urges the slide and blade into the retracted position. Thus when the slide is released, the blade automatically retracts.

BRIEF DESCRIPTION OF THE DRAWING

The above and other objects, features, and advantages will become more readily apparent from the following description, reference being made to the accompanying drawing in which:

FIG. 5 is an end view taken in the direction of arrow V of FIG. 1;

FIGS. 6 and 7 are rear and front perspective views of the knife; and

SPECIFIC DESCRIPTION

Figure 3:
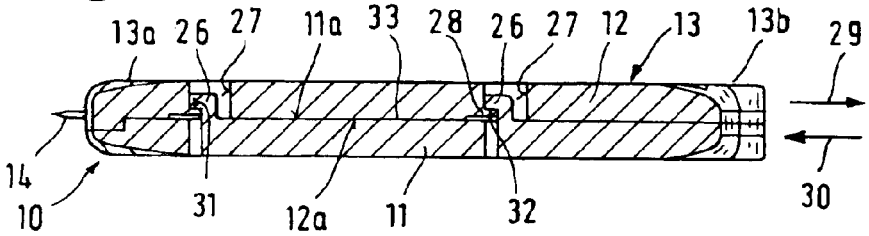
FIGS. 3 and 4 are sections taken along respective lines III—III and IV—IV of FIG. 1.

As seen in FIGS. 1 to 5, a utility knife 10 according to the invention has an elongated housing 13 having a front end 13*a* from which can project a standard steel utility-knife blade 14 and a rear end 13*b*. The housing 13 is formed by a pair of injection-molded plastic main and secondary housing halves 11 and 12 having faces 11*a* and 12*a* that abut flatly on a plane 33 extending along a longitudinal axis 18.

Figure 8:
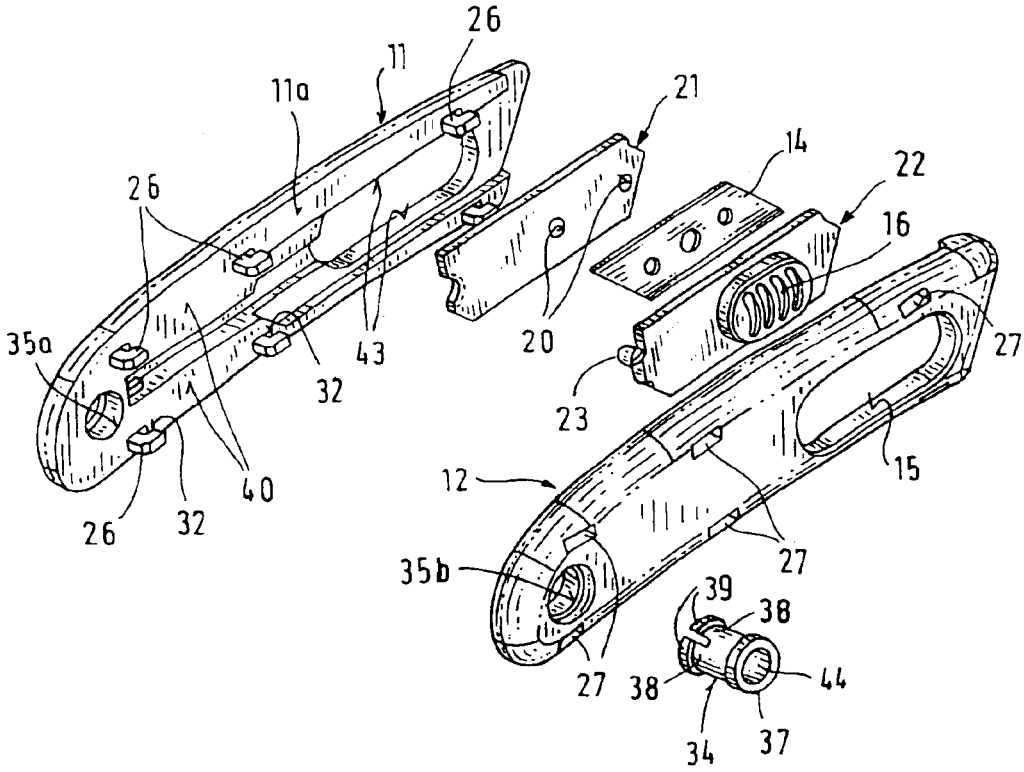
FIGS. 8 and 9 are rear and front perspective exploded views of the knife.
Figure 9:
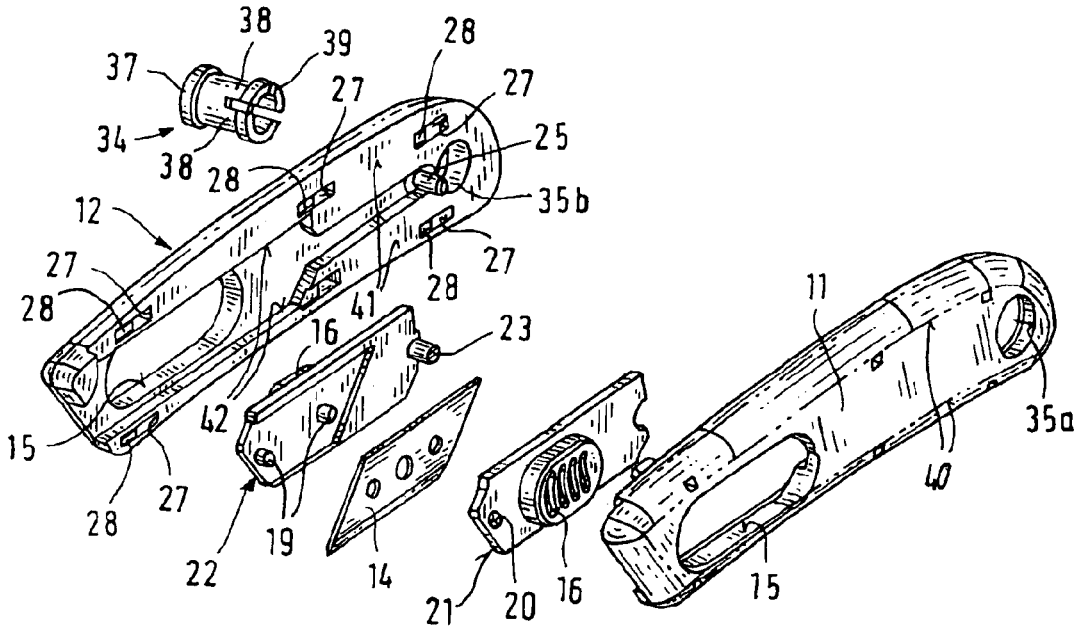

The housing halves 11 and 12 are each formed near the front end 13*a* with a transversely throughgoing and longitudinally elongated slot 15 in each of which is slidable a bump 16 of a slide 17 having a pair of slide halves 21 and 22 sandwiching the blade 14 and meeting on the plane 33. As shown in FIGS. 8 and 9, the halves 11 and 12 have longitudinally extending edge surfaces 42 and 43 that guide the slide 17. The bumps 16 of the halves 21 and 22 of the slide 17 each have a transversely directed grooved surface 16*a* exposed at the respective slot 15. Thus a right- or left-handed user holding the knife 10 can press his or her thumb through one of the slots 15 against the respective surface 16*a* to shift the slide 17 and blade 14 parallel to a longitudinal axis 18 of the housing 13 between the illustrated use position with the blade 14 projecting from the end 13*a* and an unillustrated rear position with the blade 14 retracted wholly inside the housing 13.

As shown in FIG. 9, the slide half 22 is formed with pins or bumps 19 that project across the plane 33, that fit into complementary seats or bores 20 on the other slide half 21, and that pass through the blade 14 to lock it in place in the slide 17. The slide half 22 is formed with a transversely projecting pin 23 to which is hooked a front end 24*a* of a tension spring 24 having a rear end 24*b*, hooked to another pin 25 formed on the secondary housing half 12 near the rear end 13*b* of the housing 13. Thus this spring 24 pulls the blade 14 and slide 17 back into the retracted position unless the user's thumb is pressed against one of the surfaces 16*a* to forcibly lock the slide 17 in place.

Figure 1:
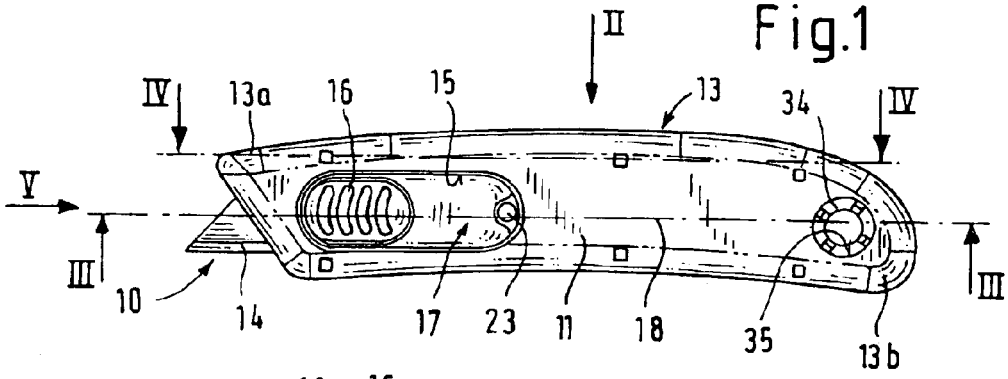
FIG. 1 is a side view of a utility knife according to the invention.
Figure 4:
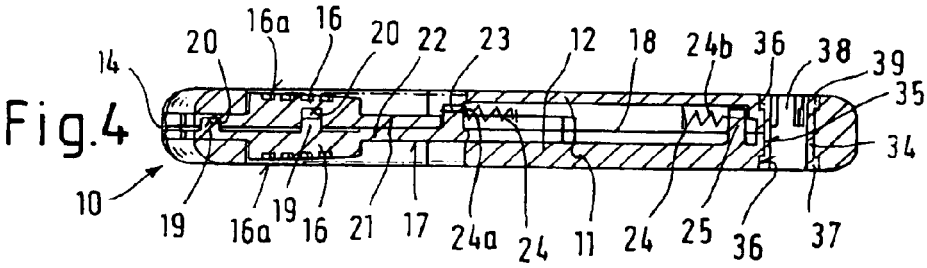
Figure 2:
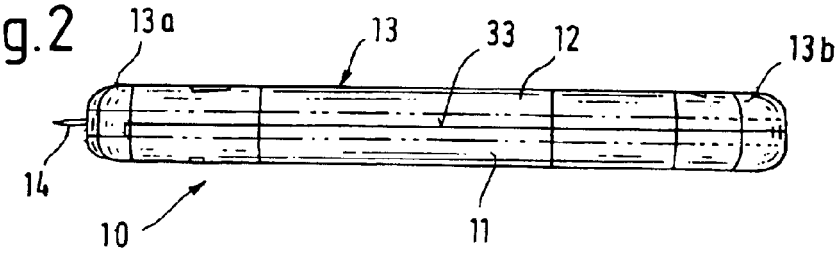
FIG. 2 is a top view taken in the direction of arrow II of FIG. 1.

According to the invention as better shown in FIGS. 6 to 9, the main housing half 11 is formed along a peripheral line 40 with six hooks 26 projecting transversely across the plane 33 and engaged in respective seats or holes 27 formed along an identical peripheral line 41 of the secondary housing half 12 and each having an undercut 28 so that the holes 27 are generally complementary to the hooks 26. As best shown in FIG. 1, the hooks 26 have angled inner faces 32 that fit with complementary angled faces 31 of the seats 27. Thus the two halves 11 and 12 can be fitted transversely together with the hooks 26 engaging into the holes 27, and then the secondary housing half 12 is shifted in a longitudinal direction 29 relative to the main housing half 11 or the main housing half 11 is shifted in a longitudinal direction 30 relative to the secondary housing half 12 to engage the faces 31 and 32 together, thereby locking the two halves 11 and 12 together with a camming action that presses their faces 11*a* and 12*a* tightly and, indeed, hermetically together.

To prevent the two halves 11 and 12 from shifting relatively longitudinally, as this could cause them to separate from each other, the halves 11 and 12 are formed with holes 35*a* and 35*b* that together form at the rear end a transversely throughgoing cylindrical hole 35 having at each outer end a setback 36. A retaining element, here a sleeve 34, has a head 37 engaged flush in one of the setbacks 36 and at the opposite setback 36 it has lips 39 bent back from split regions 38 of this sleeve 35. The lips 39 are flush with the outer face of the part 12 so that there are no projecting parts of the sleeve 34 and it is extremely difficult or impossible to remove. This sleeve 34 forms a transversely throughgoing hole 44 that is handy for hanging up the knife 10.

I claim:

1. A utility knife comprising:

a main elongated housing half formed with a transversely throughgoing aperture, having a flat face, and formed on the flat face with a peripheral annular array of transversely projecting hooks each having an outer end with a hook edge directed back toward the flat face;

a secondary elongated housing half geometrically similar to the main housing half, having a flat face, and formed with a peripheral annular array like the array of the main half of transversely throughgoing holes opening at the respective face and each having a ledge directed transversely away from the respective face, the halves being engageable together at their faces with the hooks projecting into the holes and being relatively shiftable parallel to the faces when thus engaged to hook the hook edges in an assembled position over the respective ledges, the secondary half being formed with an aperture like the aperture of the first half and directly transversely aligned therewith in the assembled position;

a retaining member snugly engaged in and through the aligned apertures and holding the halves in the assembled position; and a blade between the halves and projecting longitudinally from the housing halves.

2. The utility knife defined in claim 1 wherein the hook edges and the ledges are flat and complementarily angled to the respective flat faces whereby on shifting into the assembled positions the edges and the ledges press the flat faces together.

3. The utility knife defined in claim 1 wherein the blade projects longitudinally from a front end of the housing halves and the apertures are provided at an opposite rear end.

4. The utility knife defined in claim 3 wherein the retaining member is a sleeve and forms a transversely throughgoing hole at the rear housing end.

5. The utility knife defined in claim 4 wherein the sleeve has one end formed with radially outwardly projecting lips bearing transversely on one of the halves.

6. The utility knife defined in claim 4 wherein the retaining member is permanently mounted in the apertures.

7. The utility knife defined in claim 1 wherein the housing halves together form an internal longitudinally extending guide and at least one of the halves is formed with a longitudinally elongated and transversely throughgoing slot at the guide, the knife further comprising:

a slide holding the blade, longitudinally displaceable in the guide between a retracted position with the blade wholly contained in the housing halves and an extended position with the blade projecting longitudinally from the housing halves, the slide having an actuation button exposed at the slot.

8. The utility knife defined in claim 7 wherein the slide has a pair of similar halves sandwiching the blade, both of the housing halves being formed with one such longitudinally elongated slide, each of the slide halves being formed with one such button exposed at the respective slot.

9. The utility knife defined in claim 7, further comprising a tension spring having a front end connected to the slide and a rear end connected to the housing, the spring urging the slide and the blade into the retracted position.

10. The utility knife defined in claim 9 wherein the blade and the spring are of steel and the housing halves and the slide halves are made of plastic.

* * * * *